US005617747A

United States Patent [19]

Kim

[11] Patent Number: 5,617,747

[45] Date of Patent: Apr. 8, 1997

[54] WASHING MACHINE WITH WATER PRESSURIZING AND SPRAYING INNER TUB WATER PASSAGES

[75] Inventor: Yong S. Kim, Kyungsangnam-Do, Rep. of Korea

[73] Assignee: LG Electronics Inc., Rep. of Korea

[21] Appl. No.: 572,571

[22] Filed: Dec. 14, 1995

[30] Foreign Application Priority Data

May 16, 1995 [KR] Rep. of Korea ..... 10345/1995

[51] Int. Cl.[6] ..... D06F 17/06

[52] U.S. Cl. ..... 68/53

[58] Field of Search ..... 68/18 F, 53

[56] References Cited

U.S. PATENT DOCUMENTS 2,270,750 1/1942 Bariffi ..... 68/18 F 2,421,242 5/1947 Clark ..... 68/18 F X 5,509,283 4/1996 Lee et al. ..... 68/53 X

*Primary Examiner*—Philip R. Coe

*Attorney, Agent, or Firm*—Ostrolenk, Faber, Gerb & Soffen, LLP

[57] ABSTRACT

A washing machine enables cleansing water pumped by a rotating blade during executing a washing operation to be sprayed upon laundry within an inner tub of the washing machine with a strong pressure. The washing machine includes a hollow cylindrical inner tub for performing washing and drying, the rotating blade rotatably projecting from a center of a bottom of the inner tub for circulating the cleansing water within the inner tub, a plurality of bent portions and cutout portions bent and cut in predetermined lower portions of a sidewall of the inner tub, a plurality of waterway casings coupled to the cutout portions and positioned below the bent portions for pressurizing and spraying circulating cleansing water into the inner tub, and a hollow cylindrical inner tub base coupled to the waterway casing housed within the inner tub for selectively supplying the circulating cleansing water to the waterway casings.

10 Claims, 6 Drawing Sheets

WASHING MACHINE WITH WATER PRESSURIZING AND SPRAYING INNER TUB WATER PASSAGES

BACKGROUND OF THE INVENTION

1. Field of the Invention

The present invention relates to a washing machine, and more particularly to a washing machine in which cleansing water pumped by a rotating blade is sprayed upon laundry with a strong pressure within an inner tub of the washing machine when a low water-level washing operation is executed.

2. Description of the Prior An

FIGS. 1 and 2 are sectional views showing an internal structure of a conventional washing machine disclosed in Japanese Utility Model Laid-Open Publication No. sho 56-108874,when respectively viewed from different sides.

As illustrated in the drawings, the conventional washing machine is provided with a cylindrical inner tub 2 having a plurality of drain holes 5 in the surface thereof to perform washing and drying operations therein, and an outer tub (not shown).

A rotating blade 4 driven to be forwardly and backwardly rotating for a regular period by a washer driving unit (not shown) is installed at the inner center of the bottom surface of inner tub 2.

A water-supply hose (not shown) for supplying cleansing water W into the inner tub 2 and a water-exhaust hose (not shown) for discharging cleansing water W in accordance with a control signal from a microcomputer (not shown) are installed on the upper side and lower side of a main body of the washing machine.

A plurality of circulating waterway casings 6 extending between the center and upper portions of a sidewall of the inner tub 2 disposed along the lower and side walls of the inner tub 2 are installed around the rotating blade 4 spaced apart from one another by a predetermined distance.

A water passage 6*a* is formed between the inner tub 2 and the plurality of waterway casings 6, which passage 6*a* is communicated with a plurality of upper discharge holes 7 in the periphery of a balance rim 9 provided on the upper portion of the sidewall of the washing machine and with central discharge holes 8 in the sidewall of the washing machine, so that cleansing water W pumped by the rotation of the rotating blade 4 is circulated during the washing operation.

A thread net 10 is provided at an upper portion of one circulating waterway casing 6 to gather waste thread or nap in cleansing water W pumped by the rotating blade 4 to be led to the upper portion via the inside of circulating waterway casing 6.

In the conventional washing machine constructed as above, a water stream is formed by a pumping force produced by the rotation of blade 4, and cleansing water W flows fluctuatingly along waterway passage 6*a* to be ejected into inner tub 2 via upper discharge holes 7 and central discharge holes 8, thereby performing the washing operation.

However, in the washing machine according to the conventional technique as described above, the central discharge holes 8 and the upper discharge holes 7 for ejecting pumped cleansing water W are positioned at the center of the inner sidewall or at the upper end of inner tub 2, so that the spray of cleansing water W via upper discharge holes 7 and central discharge holes 8 is rarely effective during the washing operation when the amount of the laundry is so small as to warrant a lower water level of the cleansing water W.

In other words, when the washing is performed with the low water level, the laundry cannot be agitated by being applied with a pulsation to enhance the washing effect when cleansing water W is ejected via upper discharge holes 7 and central discharge holes 8 disposed at the relatively high positions, thereby lengthening the washing time and degrading the efficiency of washing.

Also, the cleansing water W discharged from discharge holes 7 and 8 in the higher locations is not sufficient to dissolve detergent remaining around the rotating blade 4. Thus, the washing is insufficiently carried out, and undissolved detergent may be left even after finishing the drying cycle.

SUMMARY OF THE INVENTION

It is an object of the present invention to provide a washing machine for enhancing the efficiency of washing, in which cleansing water circulated by the rotation of a rotating blade is pressurized during the washing operation, and the pressurized cleansing water is three-dimensionally sprayed and discharged into the top, bottom, right and left directions of the laundry.

To achieve the above object of the present invention, there is provided a washing machine which includes a hollow cylindrical inner tub for performing washing and drying operations, a rotating blade rotatably projecting from a center of a bottom surface of the inner tub to circulate cleansing water within the inner tub, and a mechanism for discharging and pressurizing the cleansing water between the rotating blade and inner tub to circulate the cleansing water within the inner tub. A plurality of bent portions and cutaway portions are formed at predetermined portions of a sidewall of the inner tub, and a plurality of waterway casings are respectively coupled to the cutaway portions while being located in immediately lower ends of the bent portions for pressurizing to spray the circulating cleansing water into the inner tub. A hollow inner-tub base is coupled to the waterway casings housed within the inner tub for selectively supplying the circulating cleansing water to the waterway casings.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

One embodiment of a washing machine according to the present invention will be described with reference to the accompanying drawings.

Figure 1:
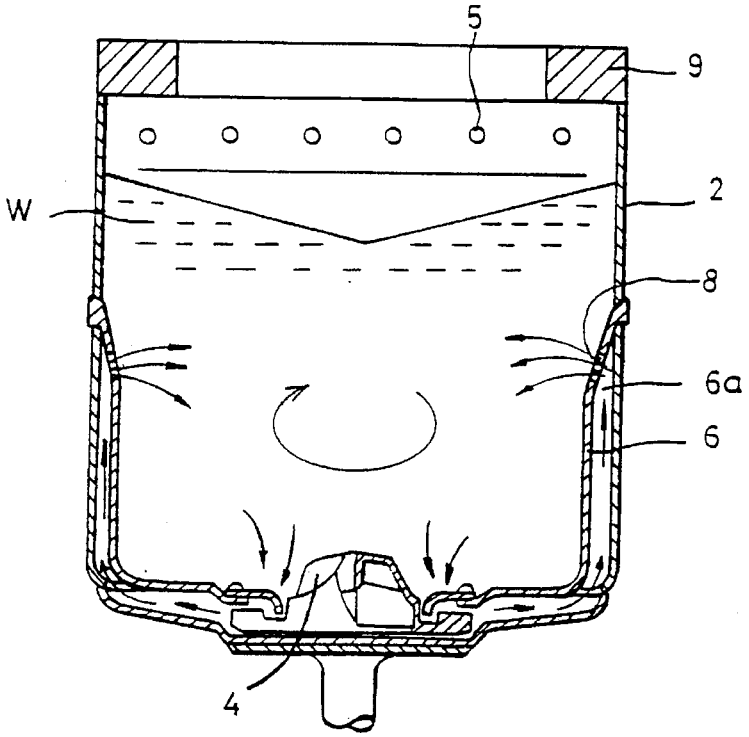
FIG. 1 CONVENTIONAL ART
FIG. 1 is a vertically-sectioned view schematically showing one example of a structure of a conventional washing machine.
Figure 2:
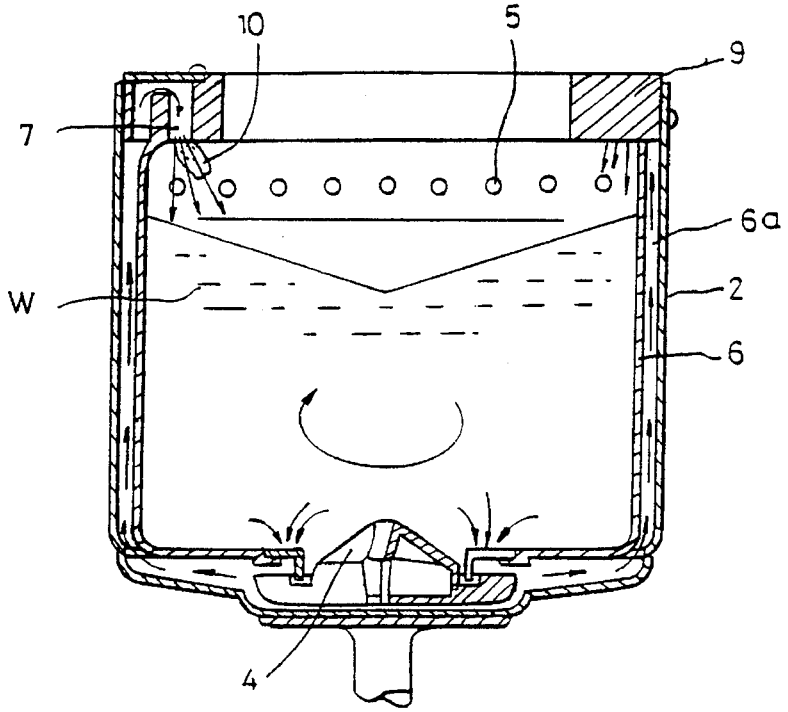
FIG. 2 CONVENTIONAL ART
FIG. 2 is a vertically-sectioned view schematically showing another example of a structure of the conventional washing machine.
Figure 3:
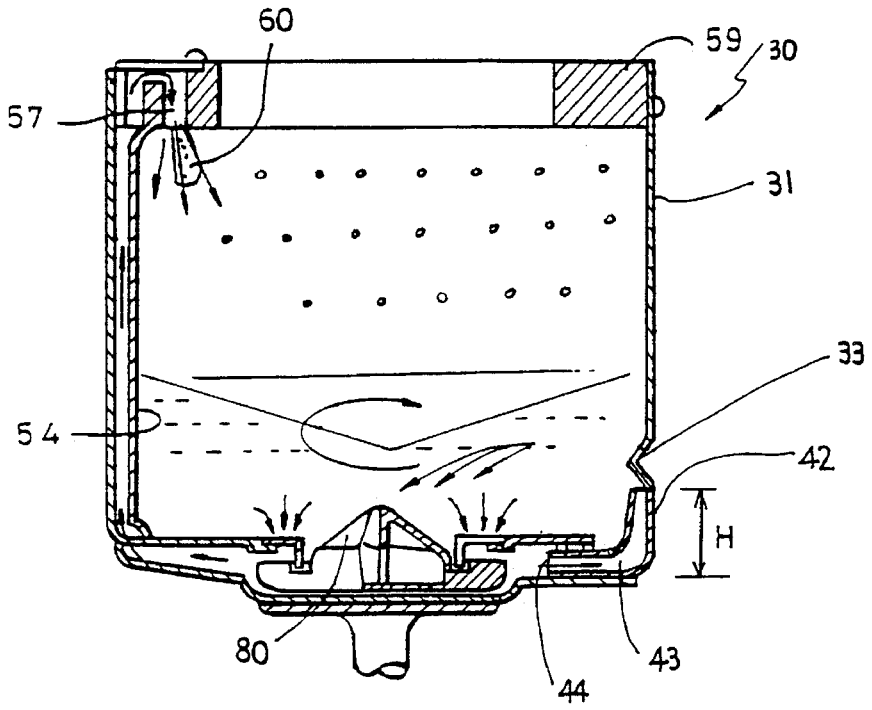
FIG. 3 is a vertically-sectioned view schematically showing a structure of a washing machine according to the present invention.
Figure 4A:
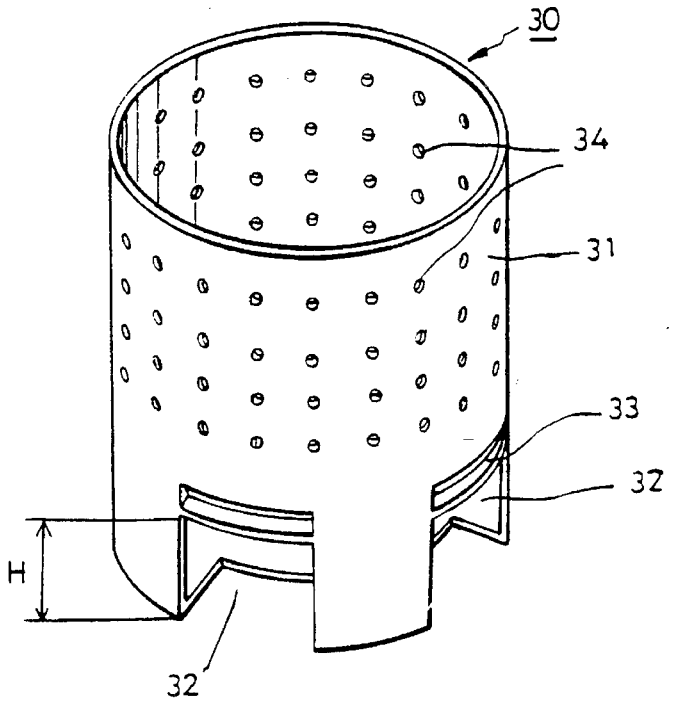
FIG. 4A is a schematic perspective view showing the inner tub of the washing machine according to the present invention.

As shown in FIGS. 3 and 4A, the washing machine includes a hollow cylindrical inner tub 30 for performing washing and drying operations therein having cutout portions 32 formed by partially cutting a lower end plane and sidewall 31 at several portions.

An inner tub base 50 selectively sprays or discharges circulating cleaning water filling up the interior of inner tub 30, and a hollow waterway casing 40 coupled to inner tub base 50 to be closely attached to the cutout portion 32 is formed in the shape of an "L" for pressurizing the circulating cleansing water into the inner tub 30. A rotating blade 80 rotatably projects from the bottom center of inner tub 30 to upwardly direct the cleansing water, thereby circulating the cleansing water.

In more detail, the inner tub 30 includes a plurality of drain holes 34 in the sidewall thereof, and the plurality of cutout portions 32 formed by cutting predetermined portions of the lower side and bottom portions of sidewall 31 are provided to have a predetermined height H and width W.

Also, bent portions 33 inwardly bent by 30°~60° are formed on sidewall 31 immediately above the upper portion of each of the cutout portions 32.

Figure 4B:
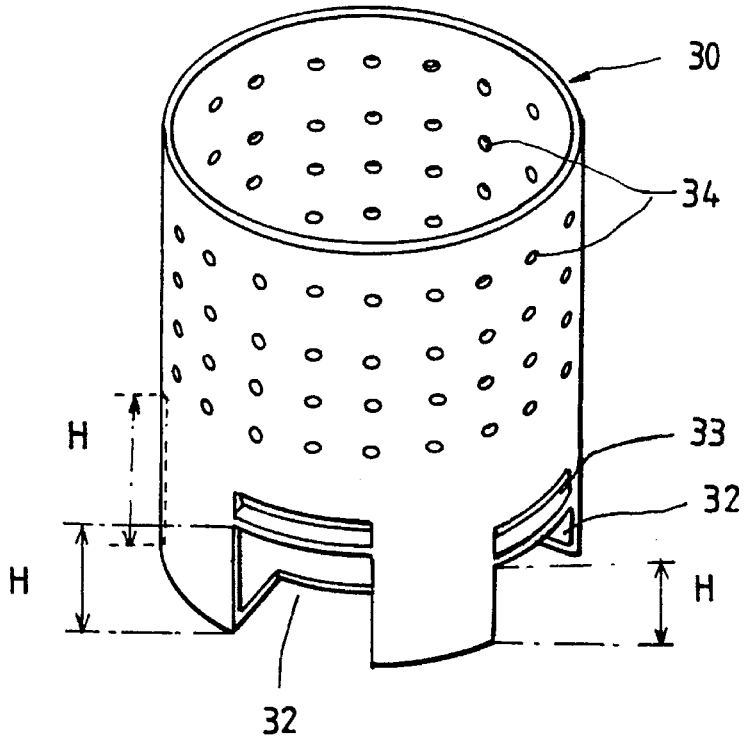
FIG. 4B is a schematic perspective view showing another example of the inner tub of the washing machine according to the present invention.

Here, the height H of the plurality of cutout portions 32 from the lower plane of inner tub 30 may be the same or may differ from one another (see FIG. 4B).

Figure 5C:
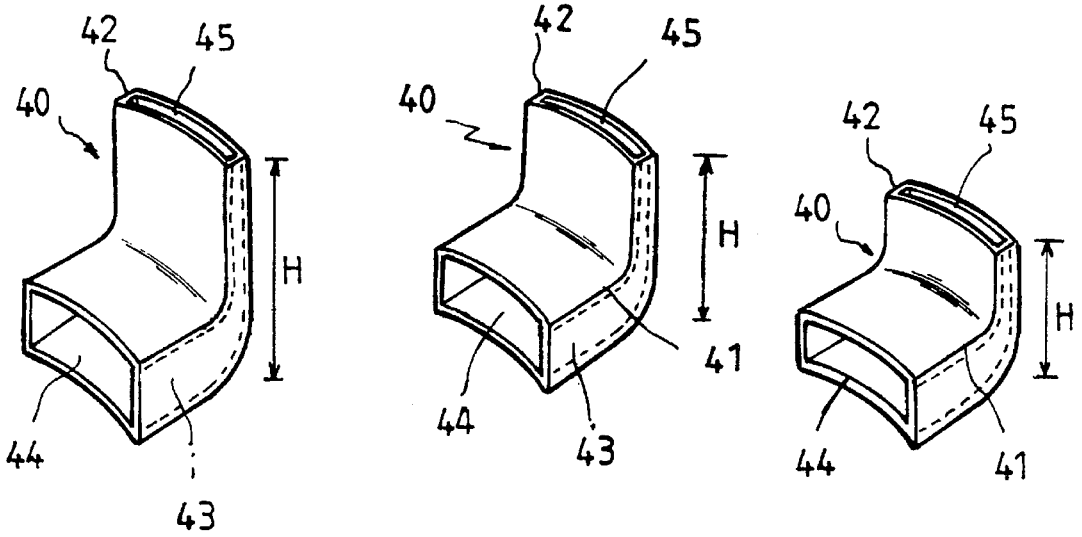
FIG. 5C is a perspective view showing a plurality of waterway casings which have different heights.
Figure 5A:
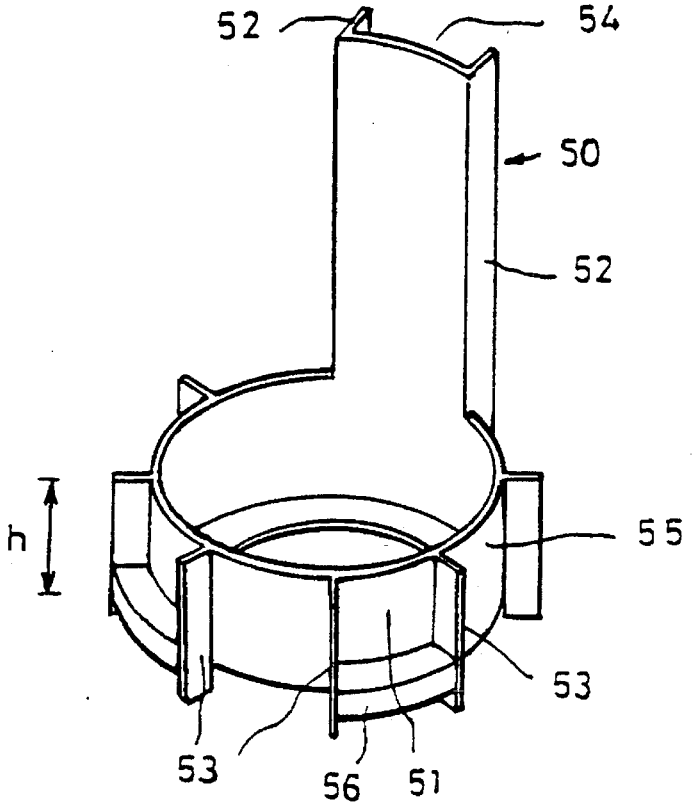
FIG. 5A is a perspective view showing the inner tub base according to the present invention.
Figure 5B:
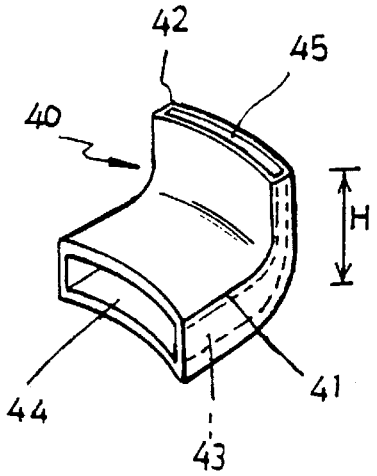
FIG. 5B is a perspective view showing the waterway casing according to the present invention.

Now, describing the shape of waterway casing 40 in detail, as shown in FIG. 5B and 5C, a lower portion 41 and a sidewall portion 42 having a predetermined height and width are integrally formed corresponding to the respective cutout portions 32 formed in the inner tub 30.

Figure 6:
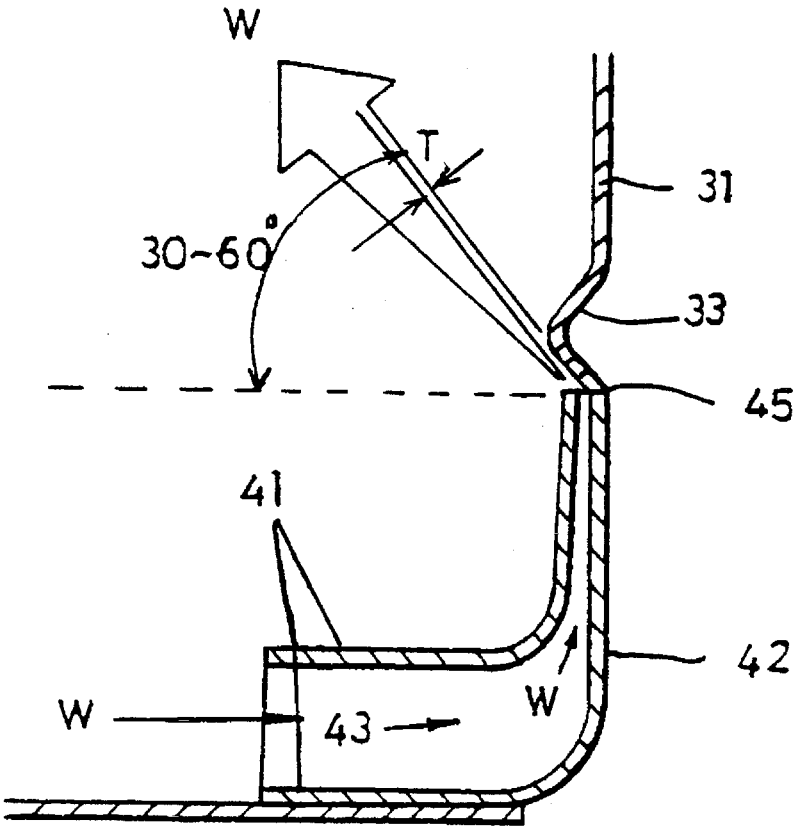
FIG. 6 illustrates the cleaning-water spray operation between the bent portion and waterway outlet employed in the present invention.

A water passage 43 is formed within the waterway casing 40, and the respective water passages 43 are formed to gradually narrow from a waterway entrance 44 of lower portion 41 to a waterway outlet 45 of sidewall portion 42, thereby producing a significantly narrowed width T as shown in FIG. 6.

Width T is a width for spraying circulating cleansing water W upwardly fluctuated by rotating blade 80 via water passage 43 of waterway casing 40.

Figure 5D:
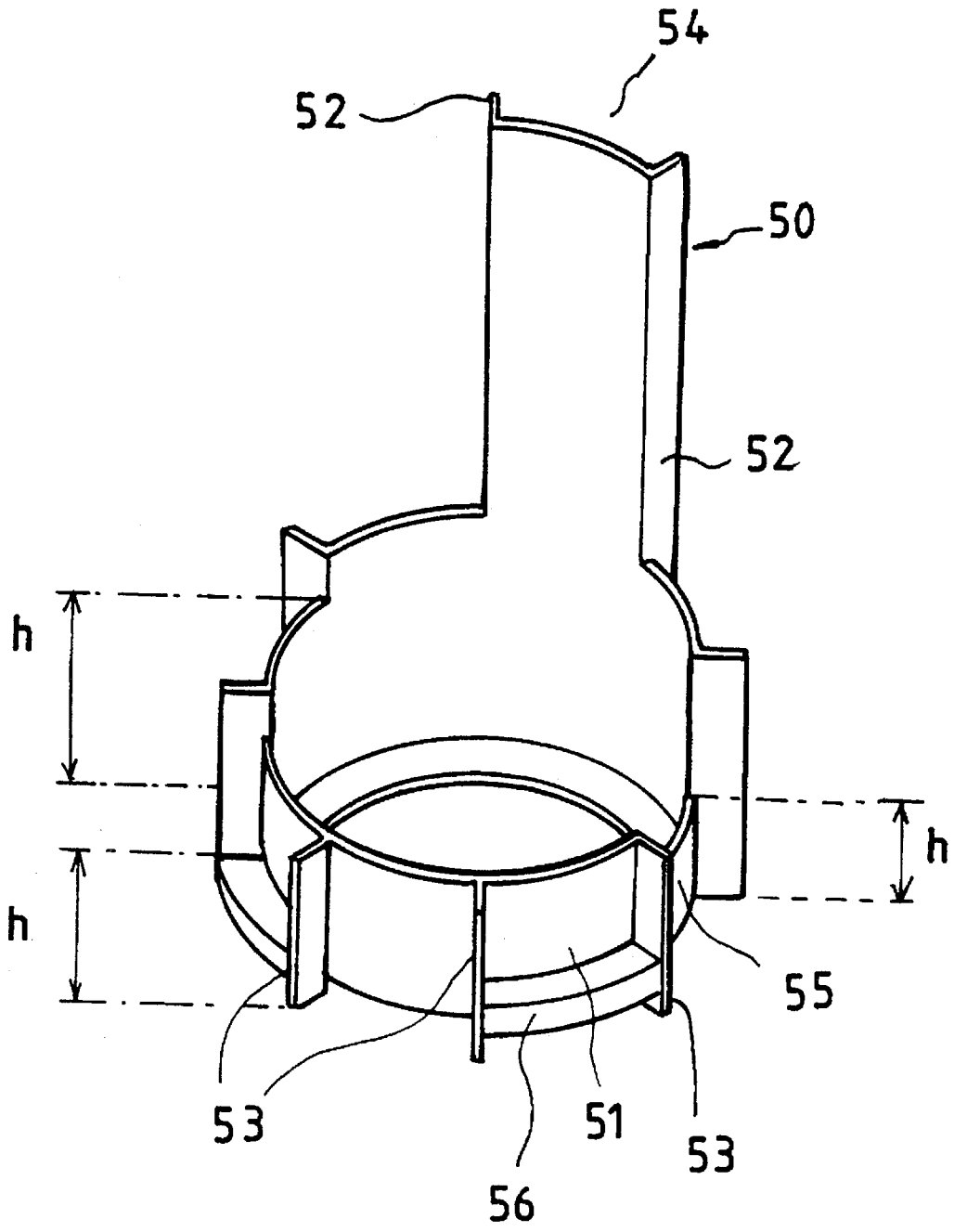
FIG. 5D is a perspective view showing another example of the waterway casing according to the present invention.

More specifically, as shown in FIG. 5A and 5D, the inner tub base 50 has an opening in its central bottom surface for accommodating the rotating blade 80 and is shaped as a hollow cylinder with a height h lower than the height H of the cutout portions 32 and with an inner diameter smaller than that of inner tub 30.

A first waterway portion 54 having a predetermined width upwardly extends from a predetermined portion of the outer sidewall of a main inner-tub base body 51 and is integrally formed with the main inner-tub base body 51, so that circulating cleansing water may be discharged therethrough into the inner tub 30.

A plurality of water blocking tubes 56 are outwardly protruded from predetermined portions of the outer sidewall of main inner-tub base body 51 except at the first waterway portion 54, and water blocking plates 52 and 53 are positioned on both sides of each water blocking tube 56, so that the inflow of cleansing water upwardly directed by rotating blade 80 is blocked.

A plurality of second waterway portions 55 corresponding to the respective waterway casings 40 are formed between the water blocking tubes 56. Consequently, as shown in FIG. 3, the cleansing water is pressurized to be sprayed out at a point where the second waterway portion 55 encounters the bent portion 33 bent toward the interior of inner tub 30 and formed immediately above the second waterway portion 55.

A cleansing water spray hole 57 provided with a thread catching net 60 is formed immediately above an upper end of first waterway portion 54.

As shown in FIG. 6, respective waterway casings 40 are coupled to respective cutout portions 32 of inner tub 30, with the top of an outer sidewall of waterway outlet 45 of each corresponding waterway casing 40 being attached immediately below the corresponding bent portion 33, and the waterway entrance 44 of the waterway casing 40 is inserted into a corresponding cutout portion 32, with the waterway casing 40 is attached on the bottom surface of the inner tub 30.

In another embodiment of the present invention, the heights of waterway outlets 45 of the waterway casings 40 from the lower plane of inner tub 30 are differently formed in order to three-dimensionally spray the circulating cleaning water into the laundry in the top, bottom, left and right directions.

Reference number 59 designates a general washtub balance rim.

Hereinafter, the operation of the washing machine according to one embodiment of the present invention will be described.

To begin with, the laundry is put in the inner tub 30 of the washing machine, and power is applied to start the washing operation. After cleansing water W fills up inner tub 30, the rotation of rotating blade 80 is reversed at regular intervals forwardly and backwardly to pump cleansing water W, so that cleansing water W is pumped toward the cleansing water spray hole 57 via first waterway portion 54 formed along the lower wall and sidewall of inner tub 30 to gather the waste thread and nap by means of thread catching net 60 installed at the upper portion of first waterway 54 while admitting cleansing water W to water passages 43 of waterway casings 40.

At this time, cleansing water W admitted to water passages 43 is compressed as it flows from waterway entrance 44 to waterway outlet 45 in accordance with the shape of the waterway casings 40 to increase its flow and spray force by Bernoulli's principle. Consequently, cleansing water W is sprayed into inner tub 30 under a strong pressure (water-stream effect) between the waterway outlets 45 and bent portions 33.

On the other hand, if the heights of the waterway outlets 45 of waterway casings 40 from the lower surface of inner tub 30 are respectively different from one another, the circulating cleansing water is three-dimensionally sprayed into the top, bottom, right and left directions to further increase the washing efficiency.

The washing machine according to the present invention as described above provided with the waterway portions is suitable for the most frequently used washing operation at a low water level. Thus, the washing rinsing performance which is basic in the washing machine is enhanced in the low water level washing operation. Moreover, by forming respective cleaning water spray passages to have stepped heights, the cleansing water is sprayed into the laundry via the cleansing water spray passages formed at the upper level of the cleansing water during the high water level washing operation, and at the same time, the fluctuation of the cleansing water can be accelerated via the cleansing water spray passages formed at the lower levels of the cleansing water. Therefore, the impact upon the laundry can be classified to further improve the washing effect.

Furthermore, any undissolved detergent left in the laundry placed in the relatively lower portion of the inner tub of the washing machine can be easily dissolved.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A washing machine including a hollow cylindrical inner tub for performing washing and drying operations, a rotating blade rotatably projecting from a center of a bottom surface of said inner tub to circulate cleansing water within said inner tub, and a means for ejecting said cleansing water under pressure between said rotating blade and inner tub to circulate said cleansing water within said inner tub, said inner tub including a sidewall, an outer circumference and a bottom surface, said washing machine further comprising:

a plurality of bent portions including lower ends and cutaway portions formed by being bent and cut at predetermined portions of said sidewall of said inner tub;

a plurality of waterway casings respectively coupled to said cutaway portions immediately below said lower ends of said bent portions for pressurizing said cleansing water to spray the circulating cleansing water into said inner tub; and a hollow inner-tub base coupled to said waterway casings and housed within said inner tub for supplying said circulating cleansing water to said waterway casings.

2. The washing machine as in claim 1, wherein said plurality of bent portions are formed at predetermined portions of said outer circumference of said inner tub and bent inwardly to each have the same height from said bottom surface of said inner tub.

3. The washing machine as in claim 1, wherein said plurality of bent portions are formed at predetermined portions of an outer circumference of said inner tub and bent inwardly to each have a different height from one another from a bottom surface of said inner tub, respectively.

4. The washing machine as in claim 1, wherein each said waterway casing is hollow having a bottom surface and a sidewall provided with a waterway portions therein, and the respective waterway portions are each gradually narrowed from a waterway entrance of said bottom surface to a waterway outlet of said sidewall.

5. The washing machine as in claim 4, wherein said plurality of waterway casings have sidewalls having the same height.

6. The washing machine as in claim 4, wherein said plurality of waterway casings have sidewalls having different respective heights from one another.

7. The washing machine as in claim 1, wherein a portion of said inner tub sidewell between said bent portion and waterway outlet is shaped to be upwardly inclined by 30°~60° toward an interior of said inner tub.

8. The washing machine as in claim 1, wherein said inner tub base includes:

a main inner tub base body having an opening in a center of a bottom thereof for accommodating placing said rotating blade, said main inner tub base body being lower than said cutout portion, and having an inner diameter smaller than that of said inner tub; and a first waterway portion extending upwardly from an outer sidewall of said main inner tub base body.

9. The washing machine as in claim 8, wherein a plurality of water blocking tubes are outwardly projected from predetermined portions of said outer sidewall of said main inner tub base body except at said first waterway portion, and water blocking plates are provided on both sides of each of said water blocking tubes.

10. The washing machine as in claim 9, wherein a plurality of second waterway portions corresponding to said waterway casings are formed in open portions between the water blocking plates to pressurize and spray said cleansing water at a point of encountering said bent portions formed at upper sides of said second waterway portions.

* * * * *